United States Patent [19]

Baird, Jr. et al.

[11] 4,123,350

[45] Oct. 31, 1978

[54] PROCESS FOR DESULFURIZATION OF RESIDUA WITH SODAMIDE-HYDROGEN AND REGENERATION OF SODAMIDE

[75] Inventors: William C. Baird, Jr.; Roby Bearden, Jr.; Ralph L. Bollinger, Jr., all of Baton Rouge, La.

[73] Assignee: Exxon Research & Engineering Co., Linden, N.J.

[21] Appl. No.: 713,510

[22] Filed: Aug. 11, 1976

Related U.S. Application Data

[62] Division of Ser. No. 571,955, Apr. 28, 1975, Pat. No. 4,017,381.

[51] Int. Cl.[2] ..... C10G 13/06; B01J 23/04; B01J 23/90

[52] U.S. Cl. ..... 208/108; 208/209; 208/235; 252/411 S; 252/438; 252/476; 423/194; 423/413; 423/560

[58] Field of Search ..... 208/108

[56] References Cited

U.S. PATENT DOCUMENTS

| | | | |
|---|---|---|---|
| 1,729,943 | 10/1929 | Hofsass | 260/667 |
| 1,937,914 | 12/1933 | Pines | 208/230 |
| 1,973,499 | 9/1934 | Morrell | 208/75 |
| 3,787,315 | 1/1974 | Bearden et al. | 208/230 X |
| 3,788,978 | 1/1974 | Bearden et al. | 208/230 X |
| 3,791,966 | 2/1974 | Bearden | 208/230 X |

OTHER PUBLICATIONS

Sittig "Sodium, Its Manufacture, Properties and Uses" Reinhold, New York, 1956 p. 217.

*Primary Examiner*—Delbert E. Gantz
*Assistant Examiner*—G. E. Schmitkons
*Attorney, Agent, or Firm*—Edward M. Corcoran

[57] ABSTRACT

Sulfur-containing petroleum oil feedstocks which include heavy hydrocarbon constituents undergo simultaneous desulfurization and hydroconversion by contacting and reacting such feedstocks with sodamide in the presence of hydrogen and at elevated temperatures. The mixture of reaction products resulting from the above procedure is separated to give a sodium sulfur salt by-product, and a petroleum oil product which has been substantially desulfurized and demetallized, as well as being significantly improved as indicated by a reduced Conradson carbon content and an increased API gravity relative to the feedstock. Sodamide is regenerated from the sodium sulfur salt by-product and can be recycled for reaction with additional feedstock.

10 Claims, 3 Drawing Figures

PROCESS FOR DESULFURIZATION OF RESIDUA WITH SODAMIDE-HYDROGEN AND REGENERATION OF SODAMIDE

This is a division, of application Ser. No. 571,955, filed Apr. 28, 1975, now Pat. No. 4,017,381.

FIELD OF THE INVENTION

This invention relates to the combined desulfurization, hydroconversion, and consequent upgrading, of sulfur-bearing hydrocarbon feedstocks by contacting the feedstock with sodamide in the presence of hydrogen and at elevated temperatures. More particularly, this invention relates to a cyclic process whereby sodamide is used to simultaneously desulfurize and hydroconvert hydrocarbon feedstocks, the resulting sodium sulfur salts being recovered and sodamide being regenerated therefrom to be recycled for use in desulfurizing and hydroconverting additional hydrocarbon feedstocks.

DESCRIPTION OF THE PRIOR ART

The problem of air pollution, particularly with regard to sulfur oxide emissions, has been of increasing concern to refiners. As a consequence, the development of efficient as well as economic means for the removal of sulfur from sulfur-bearing fuel oils has become a primary research goal. Presently, the most practical desulfurization process is the catalytic hydrogenation of sulfur-containing molecules in petroleum hydrocarbon feeds to effect the removal of these sulfur molecules as hydrogen sulfide. The process generally requires relatively high hydrogen pressures, e.g., from about 700 to 3000 psig and temperatures in the range of about 650° F. to 800° F, depending on the feedstock and the degree of desulfurization. Also these processes do not effect the simultaneous desulfurization and hydroconversion of the feedstocks employed and particularly not without a high degree of coke make during same.

The catalytic process is generally quite efficient in the handling of distillates but becomes more complex and expensive and less efficient as the feedstock becomes increasingly heavier, e.g., whole or topped crudes and residua. Thus, for example, a residuum feedstock is often times contaminated with heavy metals, e.g., nickel, vanadium, iron, and asphaltenes which tend to deposit on and deactivate the catalyst. Also, the sulfur is generally contained in high molecular weight molecules that can be broken down only with the aid of severe operating conditions. Such operating conditions, however, tend to accelerate catalyst deactivation due to the accelerated deposition of coke and metals on the catalyst surfaces.

It has also long been known that sodium and other alkali metals and hydroxides exhibit desulfurization activity for residua, but even so suffer from distinct drawbacks, such as, poor desulfurization efficiency, a tendency to produce oil insoluble sludges, the inability to upgrade the feedstock by demetallization, and the formation of salt-oil mixtures that are exceedingly difficult to resolve by conventional means. Furthermore, again none of these materials has ever been employed to obtain the simultaneous desulfurization and substantial hydroconversion of the feedstocks being treated. Recently, however, U.S. Pat. No. 3,788,978 disclosed new means for the resolution of desulfurized oil-sodium salt mixtures and U.S. Pat. No. 3,787,315 disclosed that sodium treatment in the presence of low pressure hydrogen improved sodium efficiency (i.e., the amount of sodium required to remove a given amount of sulfur), demetallization, and elimination of sludge formation.

It has also been suggested to employ sodamide as a desulfurization reagent. For example, U.S. Pat. No. 1,937,914 discloses the treatment of hydrocarbon oils with sodamide wherein the oils to be treated are vaporized and bubbled through, or otherwise contacted with molten sodamide at a temperature of 500° to 510° F. The use of sodamide for the deep desulfurization and simultaneous hydroconversion of hydrocarbon feeds is not, however, suggested in any of this prior art. In addition, sodamide is normally regarded as useful for dehydrohalogenation or certain condensation reactions, but not for the desulfurization and/or hydroconversion of hydrocarbon feeds.

In Copending Application, Ser. No. 571,946, filed on April 28, 1975 (now U.S. Pat. No. 4,007,111) William C. Baird, Jr., discloses the use of sodamide as a combined desulfurization and hydroconversion agent.

SUMMARY OF THE INVENTION

In accordance with the present invention, an efficient combined desulfurization, hydroconversion and feed upgrading process is provided, wherein sulfur-bearing petroleum oil feedstocks, for example whole or topped crudes and residua containing heavy hydrocarbon constituents, are contacted in a reaction zone, preferably while in the liquid phase, with sodamide, at temperatures ranging from about 400° F. to about 2,000° F. and in the presence of sufficient added hydrogen to provide a hydrogen partial pressure within the range of from about 150 to about 5,000 psig. The reaction products produced as a result of the above contacting comprise a highly desulfurized and significantly upgraded petroleum oil, and various sodium sulfide salts, for example $Na_2S$, which is then used in regenerating sodamide for reuse in the desulfurization-hydroconversion step. In a preferred sodamide regeneration process, the sodium sulfide is converted to a sulfur-depleted sodium polysulfide, sodium nitrate or sodium chloride which is subjected to electrolysis, in the presence of ammonia, to form sodamide.

DETAILED DESCRIPTION OF THE INVENTION

The process of this invention is generally applicable to any sulfur-bearing hydrocarbon feedstock. Thus, while the process is applicable to distilates, it is particularly effective when employed to treat heavy hydrocarbons, e.g., those containing residual oils. Preferably, therefore, the process of the invention is utilized for the treatment of whole or topped crude oils and residua. Crude oils obtained from any area of the world such as the Middle East, e.g., Safaniya, Arabian heavy, Iranian light, Gach Saran, Kuwait, etc., the U.S. or Venezuelan, e.g., Tia Juana, Bachaquero, etc., as well as heavy gas oils, shale oils, tar sands or syncrude derived from tar sands, coal oils, and asphaltenes, can be treated by the process of this invention. Additionally, both atmospheric residuum (boiling above about 650° F.) and vacuum residuum (boiling above about 1050° F.) can be treated. Preferably, the feedstock is a sulfur-bearing heavy hydrocarbon oil having at least about 10% of material boiling above about 1050° F., more preferably at least about 25% of material boiling above about 1050° F.

The feedstock may be directly introduced into a contacting zone for combined desulfurization and hydroconversion without pretreatment. It is desirable, however to desalt the feedstock in order to prevent NaCl contamination of the sodium salt products of the desulfurization reaction. Desalting is well known in the refining industry and may be effected by the addition of small amounts of water to the feedstock to dissolve the salt followed by the use of electrical coalescers. The oil is then dehydrated by conventional means.

Sodamide can be blended into the feedstock in a granular form ranging from powders (100+ microns) to particles (14 to 35 mesh range). Powders are preferred, however, in order to maximize reaction rate and minimize the need for mechanical agitation beyond the point of initial blending of powders and feedstock. The amount of sodamide employed generally may range from about 1 to about 20% by weight of the feedstock, and preferably from about 1 to about 10% by weight thereof, depending on the sulfur content of the feedstock. Thus, from about 1 to about 10 moles of sodamide per mole of sulfur in the feedstock can be employed, and preferably from about 1 to about 5, and more preferably from about 2 to about 3 moles of sodamide per mole of feed sulfur.

A hydrogen-containing gas is introduced into the contacting zone as either pure hydrogen (for example, from a steam reforming process) or as a diluted hydrogen gas stream (for example, that from refinery discard streams, e.g., subsequent to hydrotreating processes, gas effluent from cat cracker or reformer light ends streams, naphtha reformer recycle hydrogen streams, and the like).

Contact of the sodamide, hydrogen and the feedstock is carried out at reaction conditions designed to maintain the bulk of the feedstock, and preferably substantially all of the feedstock, in the liquid phase and to effect simultaneous desulfurization and hydroconversion of the feedstock. Thus, the reaction of the feedstock, sodamide and hydrogen can be carried out at a temperature within the range of from 400° F. to about 2000° F. and under a hydrogen partial pressure within the range of from about 150 to about 5000 psig. In a preferred embodiment of the invention where it is desired to effect desulfurization and demetallization while simultaneously effecting substantial hydroconversion of heavy constituents of the feedstock to light, lower boiling components, the feedstock, sodamide and hydrogen are contacted at a temperature within the range of from about 500° to about 2000° F., and preferably within the range of from about 750° to about 1000° F., under a hydrogen partial pressure of within the range of from about 500 to about 5000 psig, and preferably within the range of from about 1000 to about 3000 psig. It thus will be noted that increase in temperatures and increase in hydrogen partial pressures allows increasing hydrogen consumption by the feedstock with concomitant increasing product quality including increased demetallization, substantial desulfurization, a substantial reduction of Conradson carbon content and a substantial increase in API gravity.

Where it is desired to primarily desulfurize the feedstock without substantial hydroconversion thereof, the feedstock, sodamide, and hydrogen may be contacted at a temperature within the range of from about 400 to about 750° F. and preferably within the range of from about 550 to about 750° F., under a hydrogen pressure within the range of from about 150 to about 950 psig, and preferably within the range of from about 500 to about 750 psig.

The desulfurization and hydroconversion can be conducted as a batch or continuous type operation. The apparatus used in carrying out the desulfurization and hydroconversion is of a conventional nature and can comprise a single reactor or multiple reactors equipped with shed rows or other stationary devices to encourage contacting; orifice mixers; efficient stirring devices such as mechanical agitators, jets of restricted internal diameter, turbomixers, and the like.

The hydrocarbon feedstock and the sodamide can be passed through one or more reactors in concurrent, crosscurrent, or countercurrent flow, etc. It is preferable that oxygen and water be excluded from the reaction zones; therefore, the reaction system is normally purged with dry nitrogen and the feedstock dried prior to introduction into the reactor. It is understood that trace amounts of water, i.e., less than about 0.5 weight percent, preferably less than about 0.1 weight percent based on total feed, can be present in the reactor. The resulting oil dispersion is subsequently removed from the desulfurization zone and resolved by conventional means.

The salt product produced in the above reaction generally comprises sodium sulfide, or sodium hydrosulfide if hydrogen sulfide is employed to quench the reaction mixture. The salt product is conveniently separated from the desulfurized feedstock by filtration, centrifugation, decantation, etc.

In accordance with the present invention, sodamide is regenerated from the sodium sulfur salts produced in the desulfurization step wherein the sodium sulfur salts are converted to a sodium polysulfide, sodium nitrate, or sodium chloride, which undergoes electrolysis in the presence of ammonia, and the sodamide thereby produced may be recycled for use in conjunction with hydrogen in further desulfurizing and hydroconverting petroleum oil feedstocks.

METHOD A, SALT CONVERSION TO A SODIUM POLYSULFIDE AND ELECTROLYSIS THEREOF

In this method, oil-salt mixture purged of ammonia is treated with hydrogen sulfide to form molten sodium hydrosulfide which is converted to sodium polysulfide (preferably sodium tetrasulfide). The sodium polysulfide is subjected to electrolysis in the presence of gaseous ammonia in a beta-alumina membrane cell which is described in U.S. Pat. No. 3,785,965, the disclosure of which is incorporated herein by reference. Steps in the regeneration scheme are summarized by the following equations:

Sodium Hydrosulfide Formation $$Na_2S + H_2S \rightarrow 2NaSH$$

Sodium Tetrasulfide Formation $$2NaSH + 6Na_2S_{4.5} \rightarrow 74Na_2S_4 + H_2S$$

Sodamide Formation (Electrolytic)

$$5Na_2S_4 + 2NH_3 \rightarrow 2NaNH_2 + 4Na_2S_5 + H_2$$

Molten sodamide is withdrawn from the electrolytic cell and returned to the desulfurization-hydroconversion zone. The sodium pentasulfide is withdrawn from the electrolytic cell and is subsequently pyrolyzed to yield sulfur and the non-stoichiometric sulfide ($Na_2S_{4.5}$) which may be reacted with sodium hydrosulfide to prepare sodium tetrasulfide, as indicated above.

METHOD B, SALT CONVERSION TO SODIUM NITRATE AND ELECTROLYSIS THEREOF

In this method, a desulfurized oil-sodium sulfide mixture is purged of ammonia with hydrogen and the mixture is then contacted with water to separate the oil from aqueous sodium salts. The aqueous sodium salts are steamed to release hydrogen sulfide which is converted to elemental sulfur by means of the Klaus process. Aqueous sodium hydroxide thereby produced is neutralized with nitric acid and/or oxides of nitrogen to produce sodium nitrate which is recovered by spray drying. The anhydrous sodium nitrate is electrolyzed in liquid ammonia as described by Sittig, Sodium, Its Manufacture, Properties and Uses, Reinhold New York, 1956, page 217, to produce sodamide which is recycled for treatment of feedstocks. The gaseous by-products from the electrolysis are converted to nitric acid in a conventional manner. Alternatively, the gaseous by-products (oxides of nitrogen) may be employed in the Klaus process in the oxidation of hydrogen sulfide to sulfur.

The steps in the above sodamide regeneration scheme are summarized by the following equations:

Sodium Hydroxide Formation $$Na_2S + 2H_2O \rightarrow 2NaOH + H_2S$$

Sodium Nitrate Formation $$NaOH + HNO_3 \rightarrow NaNO_3 + H_2O$$

Sodamide Formation $$NaNO_3 + NH_3 \rightarrow NaNH_2 + \tfrac{1}{2}H_2 + NO + O_2$$

Molten sodamide is withdrawn from the electrolytic cell, and the sodamide is dispersed in the feedstocks before it is charged to the desulfurization-hydroconversion zone.

METHOD C, SALT CONVERSION TO SODIUM CHLORIDE AND ELECTROLYSIS THEREOF

This method is similar to Method B except that the aqueous sodium sulfide separated from the desulfurized oil reacts with hydrochloric acid to release hydrogen sulfide (which may be converted to elemental sulfur by means of the Klaus process), and yield a sodium chloride salt solution. After spray drying of the sodium chloride, the sodium chloride is electrolyzed in liquid ammonia as described in the Sittig reference referred to above. Hydrogen and chlorine produced in the electrolysis step may be combined to form hydrogen chloride for recycle, while the sodamide is recovered from the electrolytic cell. The sodamide is dispersed in petroleum oil feedstock before it is charged to the desulfurization-hydroconversion zone. The steps in the sodamide regeneration scheme are summarized by the following equations:

Sodium Chloride Formation $$Na_2S + 2NCl \rightarrow 2NaCl + N_2S$$

Sodamide Formation $$2NaCl + 2NH_3 \rightarrow 2NaNH_2 + H_2 + Cl_2$$

DETAILED DESCRIPTION OF THE DRAWINGS

Figure 1:
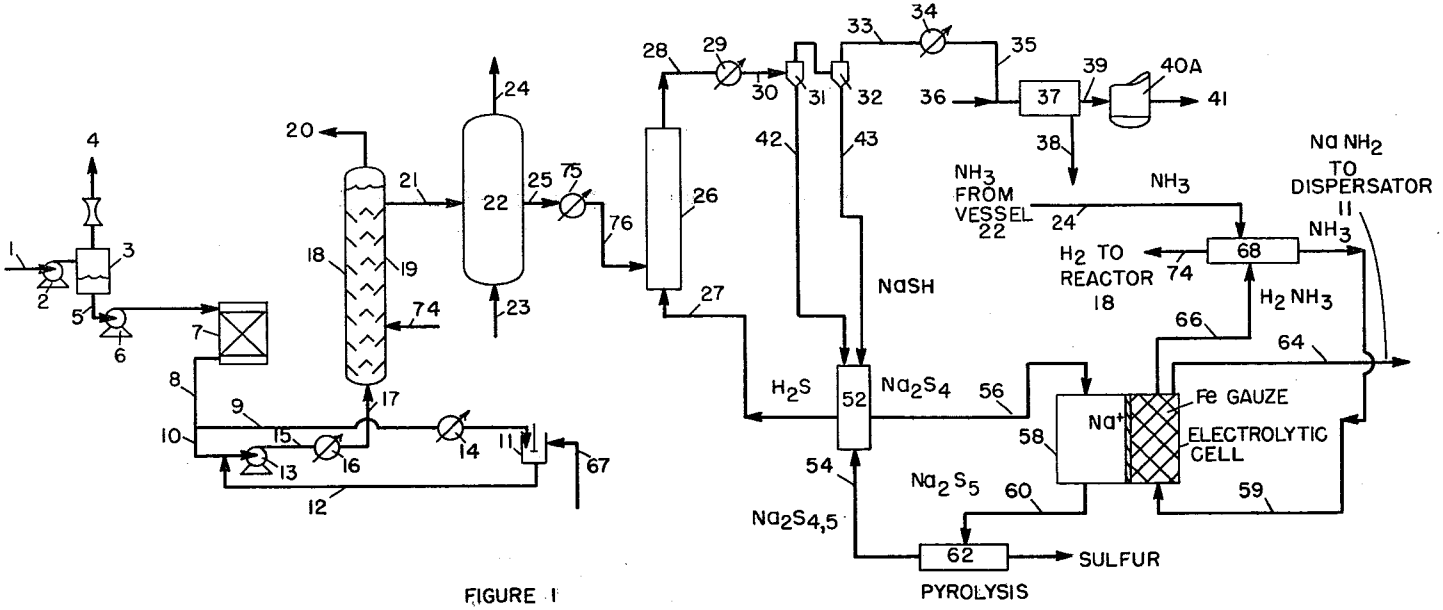
FIG. 1 is a flow diagram of a preferred embodiment of the overall desulfurization-hydroconversion process of the invention including the regeneration of sodamide in accordance with Method A.

Turning now to FIG. 1, a sulfur-containing feedstock, preheated to 450° to 500° F., is fed by means of line 1 and pump 2 to separator vessel 3 where trace amounts of water and light hydrocarbon fractions are removed through line 4. The feed is then discharged through line 5 by pump 6 to filter vessel 7 wherein particulate matter, i.e., coke, scale, etc., is removed.

The feed may be preliminarily desalted by conventional means (not shown). Feed exiting the filter via line 8 is split into two streams. A small portion is fed through line 9 and heat exchanger 14 to dispersator vessel 11 where a dispersion is formed with sodamide entering through line 67. The dispersator vessel is of a conventional design and is operated at 450° to 500° F. at atmospheric pressure. The vessel is blanketed with hydrogen. The resultant dispersion, drawn through line 12, blends with the balance of the feed in line 10 and enters the charging pump 13, where the minimum pressure is raised to about 500 psig. The feedstock will ordinarily be a whole crude of about 1 to about 3 weight percent sulfur based on total feed or a residual stock of about 2 to about 7 weight percent sulfur based on total feed.

The feedstock enters heat exchanger 16 via line 15 where its temperature is raised to from about 650° to 850° F. and is then fed through line 17 to reactor vessel 18. The reactor contains baffles 19 to promote continuing contact between sodamide and the oil and to prevent bypassing from the inlet to the outlet. Hydrogen is introduced into the reactor vessel 18 via line 74 in amounts such that the total partial pressure of hydrogen in the reactor ranges between about 500 and 3000 psig. Holding time in the reactor is about 15 to 60 minutes and is preferably 30 minutes. The temperature at the top of reactor 18 is about 820° F. but can range as high as 900° F. Gas that is formed due to the increase in temperature and excess hydrogen is taken over-head through line 20 and is condensed and depressurized by conventional means (not shown). The desulfurized feedstock containing dispersed sodium sulfide and other salts leaves the top of reactor 18 via line 21.

The dispersion exits through line 21 at about 800° F. and 1500 psig and is then passed to ammonia purge vessel 22 where the pressure is lowered to 50–300 psig.

Hydrogen gas is fed through line 23 into ammonia purge vessel 22 wherein it purges the ammonia, the ammonia and hydrogen and light hydrocarbon exiting vessel 22 through line 24. The hydrogen is then separated from the ammonia by conventional techniques and may be returned to the reactor vessel 18 while the ammonia may be employed to form sodamide. Light hydrocarbons are separated, scrubbed to remove ammonia, dried and directed to storage (not shown).

Sodium sulfide-oil dispersion exiting vessel 22 via line 25 to heat exchanger 75 where the temperature is adjusted to 650–750° F. and is introduced into contacting vessel 26 via line 76 wherein the dispersion is contacted with 110 to 400 mole percent and preferably from about 120 to 160 mole percent hydrogen sulfide (introduced into vessel 26 via line 27) based on the total moles of salts contained in the oil, at a temperature of between about 600° and 800° F., and preferably between about 500° and 750° F., thereby converting the sodium sulfide to sodium hydrosulfide. The pressure is maintained between about 50 and 300 psig. Residence time in the contactor vessel is on the order of about 10 minutes, although longer or shorter times may be used if desired.

The $H_2S$-treated dispersion exits through line 28 at about 700° F. and 25 to 100 psig, and is then cooled to about 250° F., in heat exchanger 29. The mixture is then fed through line 30 to hydrocyclone vessels 31 and 32 in series, where sodium hydrosulfide is disengaged. Alternatively, the $H_2S$-treated dispersion exiting through line 28 may be maintained above the melting point of sodium hydrosulfide, i.e., at about 700° F. and the oil and molten salt may be separated in a liquid-liquid separation (not shown). Desulfurized oil is withdrawn via line 33 to heat exchanger 34 and exits at about 250 to 300° F., through line 35. An acid, such as dilute sulfuric acid or acetic acid may be injected into line 35 through line 36 to react with oil-soluble sodium salts. e.g., sodium mercaptides and the like and the resultant mixture enters the electrostatic precipitator 37. The acidic aqueous phase from vessel 37 is withdrawn through line 38 and discarded. Desulfurized oil is fed through line 39 to steam stripper **40*a* and subsequently to storage via line 41**.

In carrying out Method A for regeneration of sodamide, the sodium-sulfur salts, which will usually comprise sodium sulfide, are converted to sulfur-depleted sodium polysulfide, that is $Na_2S_y$ where $y$ varies from about 2.8 to about 4.5, preferably from about 3.5 to about 4.3, most preferably from about 4.0 to 4.2, for example, 4.0. The conversion of the sodium-sulfur salts to the sulfur-depleted sodium polysulfide may be carried out in accordance with any of the procedures therefor disclosed in U.S. Pat. Nos. 3,785,965, 3,787,315, 3,788,978 and 3,791,966.

Oil-salt slurry drawn from the hydroclone vessels through lines 42 and 43 includes the sodium hydrosulfide (NaSH) which is readily separated from the oil. Thereafter, the NaSH is fed into contacting vessel 52 where it is contacted with $Na_2S_x$ (introduced via line 54) wherein $x$ varies from about 4.0 to about 4.9, preferably from about 4.4 to about 4.8, most preferably from about 4.5 to about 4.7, to form the sulfur-depleted polysulfide $Na_2S_y$ and hydrogen sulfide. The hydrogen sulfide may be recycled via line 27 to vessel 26 for reaction with sodium sulfide to form additional sodium hydrosulfide.

It is also possible, and perhaps desirable, to convert NaSH to $Na_2S_y$ by contact with molten sulfur rather than the molten polysulfide $Na_2S_x$. According to this procedure, molten sulfur obtained from pyrolysis of the electrolysis product, $Na_2S_z$, is added to the oil-free, molten NaSH stream. Normally, sufficient sulfur is added to give the desired electrolysis feed, i.e., $Na_2S_y$, where $y$ ranges from about 3.5 to 4.3.

It should be noted that in each of the foregoing schemes for the recovery and conversion of desulfurization salts, the hydrogen sulfide is liberated when the $H_2S$-treated salts are contacted with sulfur-rich sodium polysulfide or elemental sulfur. The hydrogen sulfide is recovered, purified to remove traces of water and recycled in the process.

The amount of $Na_2S_x$ that is required to react with the $H_2S$-treated salt mixture varies and is dependent on the compositions of both the sulfur-rich polysulfide and the sulfur-depleted polysulfide. The reaction of $Na_2S_x$ with either $Na_2S$ or NaSH is thought to proceed as follows:

$$Na_2S + n\,Na_2S_x \rightarrow (n+1)\,Na_2S_y$$

$$2NaSH + m\,Na_2S_x \rightarrow (m+1)\,Na_2S_y + H_2S$$

From the above stoichiometry, it is seen that the same amount of $Na_2S_x$ is required to react with NaSH as with $Na_2S$ to yield the same quantity of $Na_2S_y$. The values of $n$ and $m$ in the above equations will depend on the values chosen for $x$ and $y$. Using the equations, the amount of $Na_2S_x$ required to react with a salt mixture comprising 1 mole of $Na_2S$, i.e., 2 moles of NaSH, i.e., $m$ is:

Moles $Na_2S_x$ to react with 1 mole of $Na_2S = y - 1/x - y$ where:

$y$ = the number of sulfur atoms in $Na_2S_y$ $x$ = the number of sulfur atoms in $Na_2S_x$ Knowing the number of moles of $Na_2S$ and/or NaSH present in the salt mixture and the values for $x$ and $y$, the required amount of $Na_2S_x$ can be determined. It is noted that the calculated amounts of $Na_2S_x$ are minimum values and that larger quantities may be required depending on the amount of other salts that may be present in the salt mixture which also react with the $Na_2S_x$.

The sulfur-depleted polysulfide $Na_2S_y$ is fed via line 56 into electrolytic cell 58 where it is electrolyzed in the presence of ammonia (introducted via line 59) to form sodamide and sulfur-rich $Na_2S_z$ polysulfide wherein $z$ ranges from about 4.5 to about 5, preferably from about 4.7 to about 5. The $Na_2S_y$ will be employed in a mole ratio to the ammonia of within the range of from about 0.001 to about 1 and preferably from about 0.1 to about 1 per mole ammonia.

The electrolytic cell 58 may preferably comprise a sodium ion-conducting physical and electronic barrier or membrane that separates Na metal on the one side from sodium polysulfide on the other side. Generally, the membrane may be composed of any material that can function as a sodium ion-conducting separator; however, beta-alumina is preferred.

The beta-alumina may be used in the pure form or doped with a small amount of metal oxide such as MgO, $Li_2O$ and the like. A detailed discussion of doped beta-alumina is provided in an article appearing in the Electrochemical Society Extended Abstracts—Los Angeles Meeting—May 10–15, 1970, entitled "Ionic Conduction in Impurity Doped $\beta$-alumina," by Atsuo Imai et al., the disclosure of which is incorporated herein by reference. Reference is also made to U.S. Pat. No. 3,488,271 to J.

T. Kummer et al and U.S. Pat. No. 3,475,225 to G. T. Tennenhouse.

Thus, the electrolytic cell 58 will preferably comprise an anode and a cathode compartment separated by the beta-alumina membrane. The cathode will preferably comprise an iron gauze immersed in molten sodamide electrolyte over which an ammonia atmosphere is maintained. During cell operation, sodium ions migrate through the membrane to the iron gauze where electron transfer and reaction with ammonia occurs to form sodamide. At the same time, polysulfide ions give up their electrons at the electron-conducting anode to form elemental sulfur that then reacts with additional polysulfide anions to form new polysulfide ions, that is $S_z$, of greater sulfur content. The $S_z$ ions are continually removed from the cell in combined form with sodium, that is $Na_2S_z$.

It should be noted that the sodium metal is not produced in the region of the membrane and thus, sodium metal does not intrude into the fissures of the membrane to produce cracking thereof as proposed by Tennenhouse and Whalen, American Ceramic Society Meeting, Cincinnati, Ohio, May, 1973.

The electrolytic cell is operated in a temperature range such that all sodium compounds are maintained in a molten state. Accordingly, suitable cell operating temperature may range from about 550 to about 700° F. and preferably from about 600 to about 650° F., while a suitable ammonia pressure may range from about 14.7 to about 100 psig, and preferably from about 50 to about 100 psig.

It will be appreciated that the anode may comprise any suitable electron conducting-current collector that can withstand corrosive attack of the sodium polysulfide, such as iron, stainless steel, chromium, graphite, molybdenum, titanium, or aluminum. The cells are arranged preferably in series electrically, so that the anode for one cell is the cathode for the one adjacent to it.

Sulfur-rich sodium polysulfide salt ($Na_2S_z$) is recovered from the electrolytic cell 58 and is fed via line 60 to pyrolysis vessel 62 where it is reduced in sulfur content to $Na_2S_x$ (the latter being contacted with the $H_2S$-treated salt mixture as described above) by application of a vacuum and/or heat thereby liberating sulfur corresponding to that which was removed from the oil. Alternatively, at least a portion of the $Na_2S_z$ may be contacted directly with the $H_2S$-treated salt mixture.

While a beta-alumina type cell has been described, any other cell that is capable of economically decomposing sodium polysulfide into sodamide is sufficient for the present purpose. A particular beta-alumina electrolytic cell and methods for the preparation of beta-alumina are described in U.S. Pat. Nos. 3,488,271, 3,404,036, 3,468,709, 3,446,677 and 3,475,225, the disclosures of which are incorporated herein by reference.

Sodamide is recovered from electrolytic cell 58 through line 64 and is recycled to dispersator 11. Hydrogen and ammonia exiting electrolytic cell 58 via line 66 are fed to vessel 68 where the hydrogen is separated from the ammonia and fed to reactor 18 via line 74 while ammonia is fed via line 59 to the cell 58.

Figure 2:
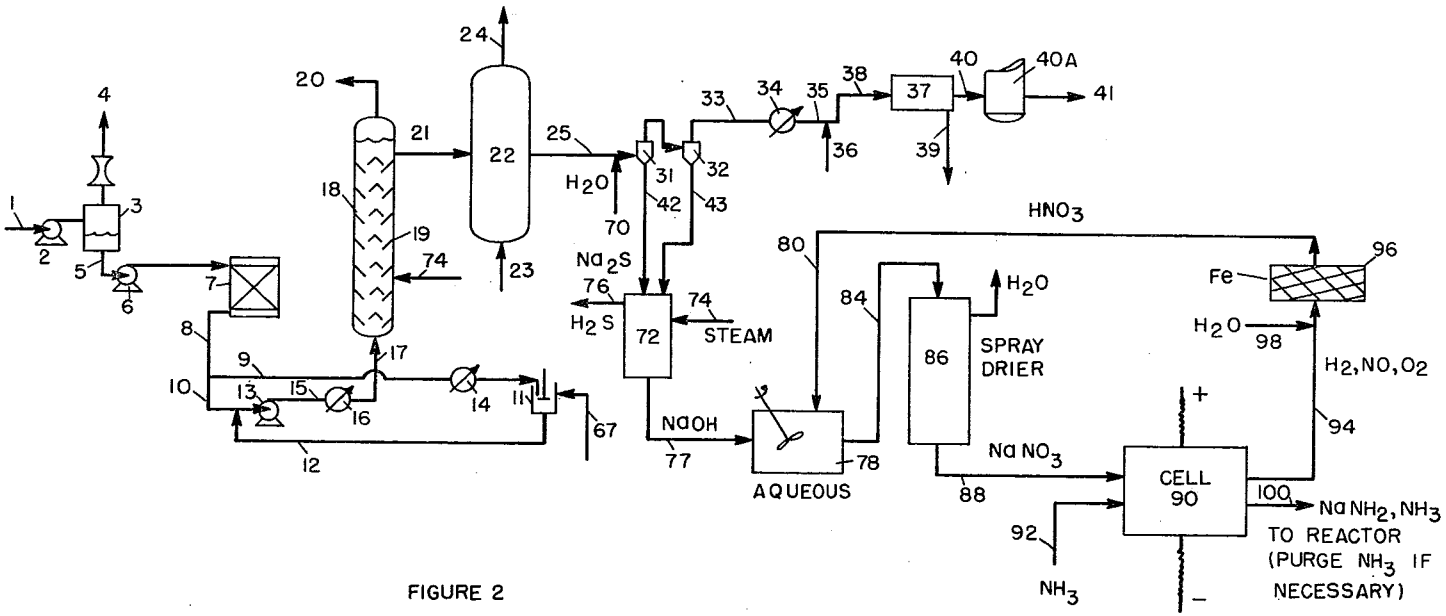
FIG. 2 is a flow diagram of the overall desulfurization-hydroconversion process of the invention essentially as shown in FIG. 1 wherein the sodamide regeneration scheme is in accordance with Method B.

In Method B, for regeneration of sodamide (as shown in FIG. 2), water is added (via line 70) to the mixture of oil and sodium sulfide to thereby separate the sodium sulfide salt phase from the oil phase in hydroclones 31, 32. Thereafter, the sodium sulfide is fed via lines 42, 43 to vessel 72 wherein steam is introduced via line 74 in amounts ranging from about 2 to about 500 moles, based on the total number of moles of sulfur present in the sodium sulfide, said steam being at a temperature ranging from about 500 to about 1500° F. and preferably from about 700° to about 1200° F. and under a pressure ranging from about 14.7 to about 100 and preferably from about 14.7 to about 50 psig. The result of the steam treatment step is to cause release of hydrogen sulfide (which may be directed via line 76 to a Klaus process for sulfur recovery), and formation of a molten sodium hydroxide. The sodium hydroxide is fed via line 77 to vessel 78 where it is neutralized with nitric acid (introduced through line 80) to produce sodium nitrate. The sodium nitrate is fed through line 84 to spray drier 86 wherein it is dried. The resulting anhydrous sodium nitrate is fed via line 88 to electrolytic cell 90 where it is electrolyzed in liquid ammonia (introduced via line 92) in accordance with the procedure described by Sittig, supra, to produce sodamide.

The sodium nitrate will be present in the electrolytic cell 90 in a molar ratio to the ammonia of within the range of from about 0.001 to about 1, and preferably from about 0.1 to about 1 moles per mole of ammonia.

Hydrogen, nitrogen oxide and oxygen are recovered from cell 90 via line 94, mixed with water introduced in line 94 via line 98, and then fed to vessel 96 wherein they are converted in a conventional manner to nitric acid. The nitric acid is recycled via line 80 to the neutralizing vessel 78. Sodamide is recovered from cell 90 via line 100 and recycled to the dispersator 11.

Figure 3:
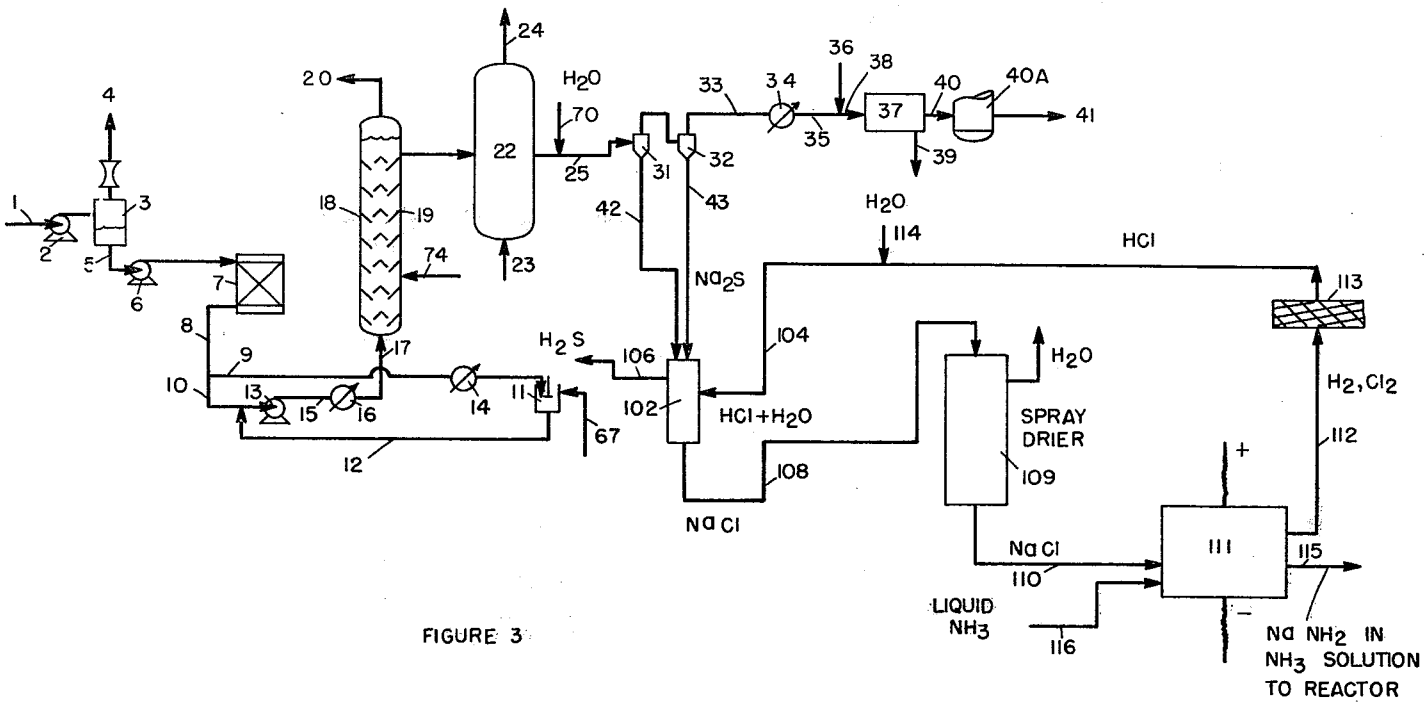
FIG. 3 is a flow diagram of the overall desulfurization-hydroconversion process essentially as shown in FIG. 2 wherein the sodamide regeneration scheme employed is in accordance with Method C.

In method C for the regeneration of sodamide (as shown in FIG. 3), water is added via line 70 to the mixture of oil and sodium sulfide to thereby separate the sodium sulfide salt phase from the oil phase in hydroclones 31, 32. Thereafter, the sodium sulfide is fed via lines 42, 43, to vessel 102 wherein it is reacted with aqueous hydrochloric acid (introduced via line 104) in amounts ranging from about 2 to about 3 moles, based on the total number of moles of sodium present in the sodium sulfide, at a temperature within the range of from about 32° to about 500° F. and preferably from about 70 to about 200° F. to form sodium chloride and hydrogen sulfide. The hydrogen sulfide may be fed through line 106 to a Klaus process for sulfur recovery. The sodium chloride is fed via line 108 to spray drier 109. The resulting anhydrous sodium chloride is fed via line 110 to electrolytic cell 111 where it is electrolyzed in liquid ammonia (introduced via line 16) in accordance with the procedure described by Sittig, supra, to produce sodamide. The sodium chloride will be present in the electrolytic cell 111 in a molar ratio to the ammonia within the range of from about 0.001 to about 1, and preferably from about 0.1 to about 1 moles per mole of ammonia.

Hydrogen and chlorine are recovered from cell 111 via line 112 and are fed to reactor 113 wherein they are converted to hydrogen chloride in accordance with conventional techniques. The resulting hydrogen chloride is mixed with water (introduced through line 114 into line 104) and the resulting hydrochloric acid is recycled to reactor 102. Sodamide is recovered from cell 111 via line 115 and recycled to dispersator 11.

It will be appreciated that the electrolytic cells 90 in FIG. 2 and 111 in FIG. 3 are of conventional construction and are fully described in the aforementioned Sittig reference.

This invention is generally applicable to heavy crudes and residua feeds, including both the 650+° F. and 1050+° F. fractions of feeds from Africa, North and South America and the Middle East. Inspection for the feedstock used in the examples is as follows:

| FEEDSTOCK INSPECTION | |
|---|---|
| Feed Designation | Safaniya |
| API Gravity | 14.4 |
| Sulfur, Wt.% | 4.0 |
| Nitrogen, Wt.% | 0.3 |
| Carbon, Wt.% | 84.4 |
| Hydrogen, Wt.% | 11.1 |
| Oxygen, Wt.% | 0.3 |
| Conradson Carbon, Wt.% | 12.1 |
| Metals, ppm | |
| Ni | 20 } 101 |
| V | 77 } |
| Fe | 4 } |
| Viscosity | |
| VSF 122° F. | 235 |
| 144° F. | 131 |
| Pour Point, ° F. | 33 |
| Naphtha Insolubles, Wt.% | 7 |

Sodamide treated oil products were analyzed not only for sulfur content, but also for changes in metal content and general physical properties, such as API Gravity, and Conradson carbon.

EXAMPLES 1 to 3

The data shown below in Table I demonstrate the effect of hydrogen pressure on desulfurization and hydroconversion of the above feed with sodamide.

TABLE I

THE EFFECT OF HYDROGEN PRESSURE (batch tests at 700° F. for 2 hrs.-treatment of Safaniya Atmospheric Residuum Feed with 9.9% Sodamide based on weight of feed)

| Example No. | Control A | 1 | 2 | 3 |
|---|---|---|---|---|
| Residuum g. | 98.8 | 95.4 | 97.6 | 94.4 |
| Sodamide g. | 10.2 | 9.5 | 10.4 | 9.3 |
| Hydrogen psig | 0 | 200 | 500 | 500 (added at 400° F.) |
| Residuum Product Analysis | | | | |
| Sulfur, Wt.% | 1.8 | 2.1 | 1.6 | 1.9 |
| Metals Ni/V/Fe(ppm) | 15/22/15 | 41/24/2 | 17/15/2 | 20/2/3/ |
| Coke, Wt.% | 6 | 0.5 | 0 | 0 |
| Conradson Carbon, Wt.% | 5.8 | 10.0 | 9.1 | 9.2 |
| API Gravity | 19 | 18.1 | 20.3 | 19.7 |
| Desulfurization, % | 55 | 47.5 | 60 | 50.5 |
| Demetallization, % | 53 | 39 | 66 | 77 |
| Conradson Carbon Removal, % | 52 | 17 | 25 | 24 |

In comparing Examples 1 and 2, it is seen that process efficiency increases with higher hydrogen pressures, so as to obtain increased % desulfurization, increased % demetallization, increased % Conradson carbon removal, increased API gravity, and decreased coke formation. As seen in Control A, where the process is carried out in the absence of hydrogen, appreciable coke formation and cracking result. Furthermore, Example 3 shows that hydrogen need not be present at the start of the run but can effectively control cracking and higher conversion if injected at a temperature below or equal to the melting point of the sodamide.

EXAMPLES 4 and 5

The data shown below in Table II demonstrate the effect of amounts of sodamide on combined desulfurization and hydroconversion.

TABLE II

THE EFFECT OF SODAMIDE CONCENTRATION (BATCH TESTS AT 700° F. FOR 2 HRS. - HYDROGEN PRESSURE 500 psig - SAFANIYA ATMOSPHERIC RESIDUUM FEED

| EXAMPLE NO. | 4 | 5 |
|---|---|---|
| Reactants | | |
| Residuum g. | 96.4 | 97.5 |
| Sodamide Wt. % feed | 5.5 | 9.9 |
| Hydrogen psig | 500 | 500 |
| Residuum Product Analysis | | |
| Sulfur, Wt. % | 2.3 | 1.3 |
| Metals Ni/V/Fe (ppm) | 0/17/3 | 8/10/7 |
| Coke, Wt. % | 0 | 0 |
| Conradson Carbon, Wt. % | 8.6 | 8.2 |
| API Gravity | 18.5 | 20.5 |
| Desulfurization, % | 42.5 | 68 |
| Demetallization, % | 82 | 77 |
| Conradson Carbon Removal, % | 29 | 31 |

It is seen from the data in Table II that process efficiency increases with higher sodamide concentrations, so as to obtain increased % desulfurization, increased % demetallization, decreased Conradson Carbon, and increased API gravity.

EXAMPLES 6 and 7

The data shown below in table III demonstrate the effect of increased hydrogen pressure and operating temperature on desulfurization and hydroconversion of the above feed with sodamide.

TABLE III

THE EFFECT OF HYDROGEN PRESSURE AND OPERATING TEMPERATURE (BATCH TESTS FOR 1 hr. - TREATMENT OF SAFANIYA ATMOSPHERIC RESIDUUM FEED WITH SODAMIDE)

| EXAMPLE NO. | 6 | 7 |
|---|---|---|
| Reactants | | |
| Residuum g. | 97.0 | 101.0 |
| Sodamide g. | 9.7 | 10.8 |
| Hydrogen Pressure psig | 500 | 1700 |
| Temperature ° F. | 700 | 820 |
| Residuum Product Analysis | | |
| Sulfur, Wt. % | 1.4 | 0.7 |
| Metals Ni/V/Fe (ppm) | 7/15/2 | 2/0/1 |
| Coke, Wt. % | 0 | 0.8 |
| Conradson Carbon, Wt. % | 8.8 | 4.8 |
| API Gravity | 20.1 | 24.1 |
| Desulfurization, % | 65 | 86 |
| Demetallization, % | 76 | 97 |
| Conradson Carbon Removal, % | 27 | 61 |

In comparing Examples 6 and 7, it is seen that where higher hydrogen pressures and temperatures are employed, there is a substantial increase in hydroconversion as reflected by increased Conradson Carbon removal and increased API gravity, and concomitant substantial increases in desulfurization and demetalization. Also the product of Example 7 contains 80 vol.% 1050° F.-distillate as compared to 60 vol.% in the feed.

EXAMPLE 8

The data shown below in Table IV demonstrate the effect of reaction time on desulfurization and hydroconversion.

TABLE IV

THE EFFECT OF REACTION TIME (BATCH TESTS AT 700° F - TREATMENT WITH SAFANIYA ATMOSPHERIC RESIDUUM WITH 9.9% SODAMIDE AND 500 psig HYDROGEN)

| EXAMPLE NO. | 8 | 6 | 5 |
|---|---|---|---|
| Reactants | | | |
| Residuum g. | 96.7 | 97.0 | 97.5 |
| Sodamide g. | 9.5 | 9.7 | 9.7 |

TABLE IV-continued

THE EFFECT OF REACTION TIME (BATCH TESTS AT 700° F - TREATMENT WITH SAFANIYA ATMOSPHERIC RESIDUUM WITH 9.9% SODAMIDE AND 500 psig HYDROGEN)

| EXAMPLE NO. | 8 | 6 | 5 |
|---|---|---|---|
| Hydrogen, psig | 500 | 500 | 500 |
| Reaction Period, hr. | 0.5 | 1 | 2 |
| Residuum Product Analysis | | | |
| Sulfur Wt. % | 1.3 | 1.4 | 1.3 |
| Metals Ni/V/Fe (ppm) | 4/29/1 | 7/15/2 | 8/10/7 |
| Coke Wt. % | 0 | 0 | 0 |
| Conradson Carbon, Wt. % | 8.5 | 8.8 | 8.2 |
| Desulfurization, % | 68 | 65 | 68 |
| Demetallization, % | 69 | 78 | 77 |
| Conradson Carbon Removal, % | 29.5 | 27 | 31 |
| API Gravity | 20.8 | 20.1 | 20.5 |

As seen in Table IV, Examples 8, 6 and 5 demonstrate that the sodamide process of the invention is not particularly sensitive to reaction period, and a holding time or space velocity suited to the conversion level desired may be selected.

EXAMPLE 9

The data set out in Table V below demonstrate the effect of carrying out the process of the invention in a staged manner by successive treatments of the feed with fresh charges of sodamide and hydrogen.

TABLE V

EFFECT OF CARRYING OUT PROCESS WITH SAFANIYA ATMOSPHERIC RESIDUUM IN A STAGED MANNER

| | STAGE 1 | STAGE 2 |
|---|---|---|
| Reactants | | |
| Resid, g | 134.2 | 80.3 |
| Reagent, g., Wt. % | $NaNH_2$, 13.4, 10.0 | $NaNH_2$, 3.0, 3.7 |
| Hydrogen, psig, Initial | 500 | 500 |
| Max. | 785 | 770 |
| Final | 240 | 400 |
| $H_2$ Consumed, SCF/B | 67 | 59 |
| Reaction Conditions | | |
| Time, Hr. | 1 | 1 |
| Temp., ° F. | 700 | 700 |
| Product Inspections | | |
| Sulfur, Wt. % | 1.52 | 0.88 |
| Nitrogen, Wt. % | — | 0.26 |
| Conradson Carbon, Wt. % | — | 7.5 |
| Ni-V-Fe, ppm | — | 9/9/9 |
| API Gravity | 19.1 | 20.7 |
| Desulfurization, % | 61.2 | 42.0 (overall 86.4%) |
| Conradson Carbon loss, % | — | 38.0 (overall 63.0%) |
| Demetallization, % | — | 75.5 (overall 83.7%) |
| Products Recovered | | |
| Liquid, Wt. % on Feed | 94.7 | 95.6 |
| Coke, Wt. % on Feed | 0.3 | 0.1 |
| $C_5$-Gas, Wt. % on Feed | 0.8 | 0.2 |

The data in Table V demonstrate that desulfurization can be increased by successive treatment of the feed with fresh charges of sodamide and hydrogen. This will be seen in comparing desulfurization of Example 6 (67%) with the desulfurization in stage 2 of Example 9 (86.4%).

What is claimed is:

1. A process for the desulfurization and hydroconversion of a sulfur-containing petroleum oil feedstock, which comprises;

contacting a sulfur-containing petroleum oil feedstock, in a desulfurization-hydroconversion zone, with sodamide in the presence of added hydrogen at a temperature of from between 400–2,000° F., said feedstock being maintained substantially in the liquid phase, thereby forming an oil-salt mixture comprising a sulfur-reduced oil phase and a salt phase, said salt phase comprising sodium sulfur salts;

contacting said mixture with water to form an aqueous sodium sulfur salt phase and to separate the oil phase from the aqueous sodium sulfur salt phase;

converting said aqueous sodium sulfur salts to sodium nitrate;

converting said sodium nitrate to sodamide; and returning at least a portion of the so-regenerated sodamide to said desulfurization-hydroconversion zore.

2. The process of claim 1 including the step of purging said oil-salt mixture of ammonia.

3. The process of claim 2 wherein said sodium nitrate is electrolyzed in an electrolytic cell in the presence of ammonia to form said sodamide.

4. The process of claim 3 including the steps of contacting at least a portion of said purged oil-salt mixture with water and separating the oil phase of reduced sulfur content and an aqueous sodium sulfur salt phase comprising sodium sulfide, contacting said salt phase with steam to cause release of hydrogen sulfide and formation of sodium hydroxide, and converting said sodium hydroxide to sodium nitrate.

5. The process of claim 4 wherein said sodium hydroxide is neutralized with a member selected from the group consisting of nitric acid, oxides of nitrogen, and mixtures thereof, to produce sodium nitrate and said sodium nitrate is dried before being fed to said electrolytic cell.

6. The process of claim 5 wherein said dried sodium nitrate is electrolyzed in liquid ammonia.

7. The process of claim 6 including the steps of recovering sodamide from said electrolytic cell, purging said sodamide of ammonia, and dispersing said sodamide in said feedstock prior to charging said regenerated sodamide into said desulfurization-hydroconversion zone.

8. The process of claim 4 wherein the hydrogen partial pressure in said reaction zone ranges from between about 150 to about 5000 psig.

9. The process of claim 8 wherein said hydrogen partial pressure ranges from between about 1500 to about 3000 psig, and said temperature ranges from between about 750 to about 1000° F.

10. The process of claim 8 wherein said hydrogen partial pressure ranges from between about 150 to about 950 psig, and said temperature ranges from between about 550 to about 750° F.

* * * * *